United States Patent [19]

Sigle et al.

[11] 4,317,293

[45] Mar. 2, 1982

[54] FOOT-SUPPORTING INSOLE

[76] Inventors: Rolf Sigle, Friedrich-Siller-Strasse 36, D-7014 Kornwestheim; Jakob Sigle, Rechbergweg 3, D-7302 Ostfildern, Kemnat, both of Fed. Rep. of Germany

[21] Appl. No.: 123,618

[22] Filed: Feb. 22, 1980

[30] Foreign Application Priority Data

Mar. 1, 1979 [DE] Fed. Rep. of Germany ..... 2908019

[51] Int. Cl.[3] ..... A43B 13/38; A43B 19/00

[52] U.S. Cl. ..... 36/43; 36/71; 128/595

[58] Field of Search ..... 36/43, 44, 71, 28; 128/581, 583–585, 595, 596

[56] References Cited

U.S. PATENT DOCUMENTS

| | | | |
|---|---|---|---|
| 1,517,610 | 12/1924 | Bayless | 36/43 |
| 1,867,431 | 7/1932 | Wood | 36/44 X |
| 2,146,888 | 2/1939 | Fisch | 36/44 X |
| 2,242,868 | 5/1941 | Musebeck | 36/44 UX |
| 2,415,580 | 2/1947 | Davis | 36/43 X |
| 2,426,735 | 9/1947 | Hiss | 36/71 |
| 3,448,533 | 6/1969 | Beckwith | 36/44 |

FOREIGN PATENT DOCUMENTS

| | | | |
|---|---|---|---|
| 588504 | 12/1959 | Canada | 36/43 |
| 691306 | 5/1940 | Fed. Rep. of Germany . | |
| 2015489 | 10/1971 | Fed. Rep. of Germany | 36/71 |
| 2634701 | 2/1978 | Fed. Rep. of Germany | 36/71 |
| 167798 | 7/1959 | Sweden | 128/595 |
| 217833 | 6/1924 | United Kingdom | 36/43 |
| 2032760 | 5/1980 | United Kingdom | 36/28 |

*Primary Examiner*—James Kee Chi

*Attorney, Agent, or Firm*—Jordan and Hamburg

[57] ABSTRACT

The invention relates to a foot-supporting insole of which the front bounding line (24) extends in front of the ball (28) of the little toe at the outside of the foot and behind the ball (27) of the big toe at the inside of the foot. To enable such an insole to be used in all conventionally marketed shoes and to ensure that correct adaptation to the foot of the wearer will not be necessary, it is suggested to make the insole (2) of resiliently elastic material of substantially constant thickness and to construct it so that it is curved upwardly at the inside (3) of the foot, the stiffness of the insole (2) at least at the outside zone of the foot being so high that the foot rotatingly rolls towards the big toe during walking. Preferably, the length of the insole (2) at the inside of the foot corresponds to a size which is several sizes smaller than the measurement corresponding to the length at the outside of the foot.

16 Claims, 5 Drawing Figures

FOOT-SUPPORTING INSOLE

The invention relates to a foot-supporting insole extending from the heel zone up to a front bounding line which extends obliquely to the longitudinal axis of the foot in front of the ball of the little toe at the outside of the foot and behind the ball of the big toe on the inside of the foot. Use of the insole according to the invention is, with an appropriate construction, possible as an insertable liner or in the same way for example as an intermediate insole insole for permanent incorporation in a shoe.

Footwear should preferably be such that on the one hand it forms a natural supporting surface for the foot when standing but on the other hand does not impede the natural rolling motion of the foot when walking and preferably assists such rolling motion. When standing, it should be possible for the ball of the big toe to be disposed somewhat lower than the ball of the little toe and the arch of the foot should also be supported, especially when standing for prolonged periods. When walking, the natural rolling motion of the foot is initiated when the heel bone makes contact. The foot should then roll in a manner such that the rolling motion is clearly directed towards the big toe, i.e. forwardly and inwardly. The big toe itself should roll straight ahead. The foregoing requirements were for the most part known in frame footwear that was until recently conventional. By reason of the hardness or stiffness of the frame, the rolling motion underwent the foregoing favourable direction during walking. In addition, the foot was capable of creating a bed favourable for standing and walking by compressing the mass of padding at the ball of the foot. However, more recently frame footwear is no longer made or made only to a limited extent because the manufacturing costs are too high. One nowadays tends to employ shoe manufacturing processes in which planar and comparatively hard insoles and planar outer soles are provided which are flexible to the same extent toward all sides of the front portion. This bed for the foot leads to unnatural sinking of the little toe and consequently rolling of the foot towards the outside by way of the little toe. To follow this direction of rolling, the big toe is often turned outwardly, which is the main cause for foot ailments, particularly hallux-valgus. If the hallux-valgus is remedied by surgery, a shoe has to be worn with which rolling towards the outside is prevented if possible so as to avoid a recurrence of the problem. However, hitherto no shoes have become available apart from the aforementioned frame shoes that meet this requirement as a result of the way they are made.

A remedy might possibly be obtained with an insole as hereinbefore defined and known from DE-PS No. 847,716. In the known insole, which can be used as a loose insert or permanently built into the shoe, the front boundary is so oblique to the longitudinal axis of the shoe that, at the outside of the foot, the little toe still rests entirely on the insert whereas at the inside of the foot the ball of the big toe comes to lie in front of the bounding line. In an insert of this construction, the ball of the big toe is bound to be placed lower than the ball of the little toe to meet the aforementioned requirements and thereby to a certain extent enhance rolling towards the big toe. However, the known insert also exhibits a multitude of defects. The most serious disadvantage resides in the fact that the known insert is relatively thick and in particular shaped so that its thickness at the outside of the foot is considerably larger than at the inside. Consequently, the insert can be worked into only specially shaped footwear having an adequately large width. In addition, it is not only the front zone of the foot but the foot as a whole that is slightly inclined inwardly, whereby there is an unnatural strain on the ankle and the occurrence of fallen arches or flat feet is enhanced. Yet another defect resides in the fact that the known insert will be generally almost completely rigid by reason of its disproportionately large thickness, so that the rolling motion of the foot is made very difficult between the heel and the ball.

Finally, a still further disadvantage of the known insert is that it must always be accurately adapted to the size of the foot. This is particularly because of the relatively large thickness which can lead to pressure points or the like if the front bounding line of the insole is not always disposed at the most favourable location.

It is the object of the invention to provide a foot-supporting insole which can be used in practically all conventionally marketed shoes, i.e. will not be excessively demanding, but which will nevertheless reliably ensure the desired rolling motion of the foot towards the big toe, an additional aim being that very accurate adaptation to the foot of each wearer will not be required.

To achieve this object in an insole of the aforementioned kind, the invention suggests that the insole should consist of resiliently flexible material preferably of substantially constant thickness over the entire area, wherein for the purpose of supporting the arch of the foot the insole is curved upwardly at the inside of the foot and the stiffness of the insole at least at the outside zone of the foot is so high that, during rolling motion when walking, the foot is turned towards the big toe.

If a suitable material is selected, the insole according to the invention can be kept relatively thin so that it can be used either as an insert liner in normal footwear or be built without difficulties into shoes of the usual construction as an insole or intermediate sole. Its configuration ensures that the foot will not assume an unnatural position. Instead, it will be disposed in the natural position when standing and in addition there will be support for the ankle. Despite this, because of the appropriate stiffness of the insole near the outside of the foot and by reason of the fact that the insole will in that location engage at least the ball of the little toe, the natural rolling motion of the foot directed towards the big toe will occur during walking. By using an insole according to the invention, therefore, the foot will be adequately supported when standing and at the same time appropriately moved when walking. The occurrence of hallux-valgus is therefore practically avoided when using an insole according to the invention. In the same way other ailments are also substantially avoided, e.g. so-called 'digitus-quintus', corns on the little toes and hardened skin. Post-operative care of feet which have received surgical treatment is also simplified when using an insole according to the invention without basically changing the outer structure of the shoes. A further important advantage of the insole according to the invention is finally to be seen in the fact that it is not necessary accurately to adapt the insole to the foot size. It is only important for the insole to terminate behind the ball of the big toe on the inside of the foot, it being possible for the spacing to be different depending on the foot size. Further, in the zone of the ball of the little toe, the insole must extend forwardly to such an extent that at least the ball of the little toe will rest on the insole. However, it will not be a hindrance if the little toe is also partially or even entirely supported by the insole and of course the fourth toe may also be supported. In this case a healthy rolling motion towards the big toe is likewise readily ensured. Another application for the insole according to the invention, particularly when it is permanently built into the shoe, is in the sports shoe sector. When using an insole according to the invention it must be expected that a runner will achieve a better performance than if he wears a shoe with an insole that is uniformly pliable as a whole. The additional support given in the zone of the little toe makes it possible to obtain better utilization of the forces emanating from the little toe or the adjacent toe during running or jumping.

Particularly in a case where the insole is to be comparatively thin, it may be favourable if a stiffening insert of elastically flexible material is provided at the outside of the foot extending up to beneath the ball of the little toe. This insert may consist of relatively stiff material whilst the rest of the insole which does not have to take up very large forces may be relatively soft by reason of its small thickness. Such a construction is of advantage particularly if, for medical reasons, intensive support appears necessary but normal footwear of not very large width is to be worn.

Provision is also made for the front bounding line to be substantially S-shaped and extend substantially perpendicular to the inner and outer edges of the insole at its start and end, respectively. This configuration is particularly advantageous if there is no accurate adaptation of the insole to the size of the foot because in that case the edge formed by the bounding line extends in a manner such that pressure points are unlikely to occur.

It has already been mentioned that a decisive disadvantage of the known inserts is that they must be very accurately adapted to a particular foot size. This is so for practically all known orthopaedic inserts, for which reason it has been usual for these inserts to be held in stock in the appropriate shops in a multitude of relatively closely graduated sizes, giving rise to a considerable expense on the part of the manufacturer as well as the retailer. In so far as such insoles are made from plastics material, it was for example necessary to produce moulds of the same graduation. This very often led to the circumference that some extreme sizes were not produced because of insufficient demand, with the result that persons having that shoe size could only obtain made-to-measure inserts which were correspondingly expensive. However, even if inserts were available in closely graduated sizes, there were still difficulties by reason of differently shaped feet because in different persons the toes certainly have a different length in comparison with the rest of the foot whereas the inserts had to be dimensioned for an average length of toe. In people with relatively long toes this then resulted in the front bounding line of the insert to be disposed too far forwardly, i.e. it came to lie under the toes whereas in people with short toes the front edge of the insert could be disposed precisely above the ball, which led to pressure points and thus difficulties in walking and standing.

The insole according to the invention permits a remedy to be obtained in this respect in that the length of the insole at the inside of the foot from the heel to the bounding line behind the ball of the big toe is dimensioned according to a measurement corresponding to a shoe size which is several, preferably at least three, sizes smaller than the shoe size corresponding to the measurement according to which the length of the insole at the outside of the foot is dimensioned from the heel to the bounding line near the ball of the little toe. With such an embodiment, an insole can be used for three shoe sizes differing by a whole size graduation so that it is generally possible to make do with a relatively limited number of sizes, for example three for men and three for women. This is made possible by the insole according to the invention because it must only be ensured that the front bounding line at the inside of the foot extends behind the ball of the big toe whereas near the outside of the foot it always engages the ball of the little toe but may certainly extend as far as the tip of the little toe. It would even be conceivable in the case of certain feet or shoes where the insole extends too far forwardly in the zone of the little toe simply to cut off the front end of the insole. This can in no case cause problems because the little toe will then rest fully on the insole and the edge produced by cutting cannot lead to pressure points. Apart from the effect that a few insole sizes will be adequate to have insoles available to fit all potential wearers, the aforementioned construction of the insole also provides the advantage that adaptation to different toe lengths is possible without difficulty. This problem actually occurs only in the case of wearers whose foot size falls between two insole sizes. One will then use the smaller insole in the case of wearers having long toes and the respective large insole for persons with short toes.

To achieve the aforementioned aim, it has been found desirable for the length of the insole at the inside of the foot to be about 70% of the length at the outside. In this case one insole size will cover three and more size graduations but will nevertheless be capable of fulfilling its intended purpose.

If it is desired to employ one insole size for different lengths of feet, one obviously also has the problem that longer feet are generally also wider and thus it must also be possible to adapt to different foot widths. This is simply achieved according to the invention if a marginal strip relatively easily highly flexible compared with the remaining area of the insole is provided along the side edges and possibly around the heel, this marginal strip preferably being formed by a line of weakness extending substantially parallel to the edge of the insole. In a construction with a relatively flexible marginal zone, the insole should readily abut the shoe upper or the sole of the shoe along its edge, which can be achieved in that a narrow marginal zone of the insole at least at its side edges and towards the heel is uniformly thinned.

The insole according to the invention can of course be made of different materials with appropriate resilient properties but manufacture from the hitherto conventional insole materials of cardboard will be excluded because of the required flexibility. However, it is particularly favourable if the insole consists of a resiliently flexible plastics material, preferably polypropylene, because it can then be made by extrusion irrespective of its shape and in addition it will have adequate mechanical strength.

The wearing properties of the insole can be still further improved in that the upper side is coarsely roughened so that an air cushion will be formed especially when made from plastics material and in addition the sole of the foot is under certain circumstances moved in a message-like manner during walking.

The insole of the invention could basically be used as an insert liner or insole without requiring special measures. However, it is favourable if it is covered at least on the upper side with a soft resilient covering layer, preferably of leather, which projects somewhat beyond the insole on all sides. The application of a covering layer is of climatic advantage particularly when the insole is made from plastics material because it will not prevent the foot from breathing. A certain projection of this covering layer has the advantage that no pressure or friction points can be set up near the edges of the insole. Naturally, the underside of the insole could also be covered. However, in general it is sufficient in the case of insert lines if the underside of the insole is slightly roughened to achieve a good overall appearance and if in addition a coloured plastics material is employed.

A defect of known insert insoles resides in the fact that they will readily slide within the shoe. One has hitherto tried to avoid this by providing the underside of the insert soles with self-adhesive zones. However, this has the disadvantage that the insert insoles can be replaced only with difficulty and in particular that the insoles can be used in only one shoe. In contrast, the invention suggests that the underside of the insole be at least partly provided with sharp-edged projections which prevent displacement of the insole in use and which can be advantageously moulded in position when the insole is made from plastics material. This has the advantage that the insole will be properly positioned in the shoe but can nevertheless be removed without difficulty for replacement or fur use in a different shoe.

Although it would be possible to apply the projections to the entire underside, this could reduce their depth of penetration, i.e. the grip. For this reason it is suggested that the projections be respectively disposed only in a strip between the heel zone and arch at the inside of the foot and a strip between the arch and the ball of the little toe at the outside of the foot. The strip at the outside of the foot should terminate a certain distance in front of the front bounding line, for example about 15 mm.

The configuration of the projections can vary. For example, it would be possible to make the projections of sawtooth formation, in which case the steeper flanks of the teeth should face the front bounding line of the insole. Another possibility would be for the projections to be conical with an apex angle of less than 90°, preferably less than 60°.

Further features, details and advantages of the invention will become evident from the following description of a preferred example with reference to the drawing, wherein.

Figure 3:
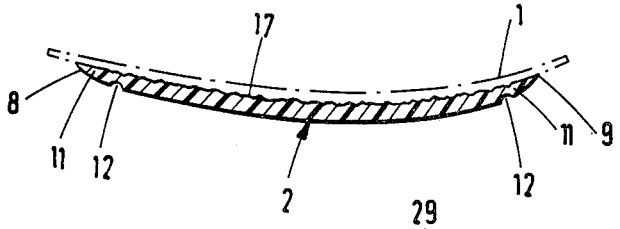
FIG. 3 is a section through the insole on the line III—III in FIG. 1 and FIGS. 4 and 5 are sectional side elevations of FIG. 2 taken in the direction of the arrows IV and V in FIG. 2.

The insole shown in the drawing is one for the right foot and preferably used as an insert liner, in which case a covering layer 1 shown in chain-dotted lines, preferably of leather, should be provided to project beyond the upper side (FIG. 1) of the insole 2 to a certain extent at all sides.

The insole 2 of the illustrated example is extruded from plastics material, preferably polypropylene, which has the advantage that the actual insole 2 as well as all special formations can be produced in one operation. In addition, this plastics material has the required resilient properties for the desired effect of the insole, i.e. with an appropriate thickness it is still sufficiently pliable. Nevertheless, the desired support is achieved.

At the inside of the foot, i.e. approximately at the position 3, the insole 2 is precurved upwardly in known manner to form a support for the arch of the foot. In addition, as clearly shown in FIG. 3, the insole is slightly concave to conform to the shape of the foot except at the front zone 4, i.e. substantially the zone in front of an imaginary line extending through the points 5 and 6 in FIG. 1. This concave formation is however interrupted by a precurvature 7 near the line 5–6 which serves as a metatarsal support. This precurvature 7 may simply be formed by appropriately deforming the insole 2. In the illustrated example, the precurvature 7 is, however, formed by appropriately thickening the insole 2 of which the remainder has a substantially constant thickness. The thickness of the insole can for example be about 1.5 mm in the zone in front of the line 5–6 whereas it can be about 3 mm thick in the zone 3 where the arch is to be supported. The thickness of the insole lies between these values practically over its entire surface but of course there is a thinning towards the edge in known manner to avoid the formation of sharp edges.

To permit clean abutment of the side edges 8, 9 and also of the edge 10 near the heel against the shoe, i.e. either the upper or the insole, the insole 2 converges towards the edges 8, 9, 10 along a marginal strip 11 extending along the side edges 8, 9 and around the heel, as best shown in FIG. 3. In addition, the underside of the insole is provided with a groove 12 which forms a line of weakness whereby the marginal strip 11 can be bent without difficulty out of the plane of the insole 2 either upwardly or downwardly to adapt to the shape of the shoe.

Further, the heel zone 13 of the illustrated insole comprises a depression 14 for receiving the heel bone, the shaping such that a curvature (not visible in the drawing) is formed which supports and lifts the heel bone at the front when a step is taken, whereby the ankle is activated on placing the foot on the ground. The recess 15 permits possible through-adhesion, it being impermissble for the margin of the recess 15 to form a sharp edge.

Figure 1:
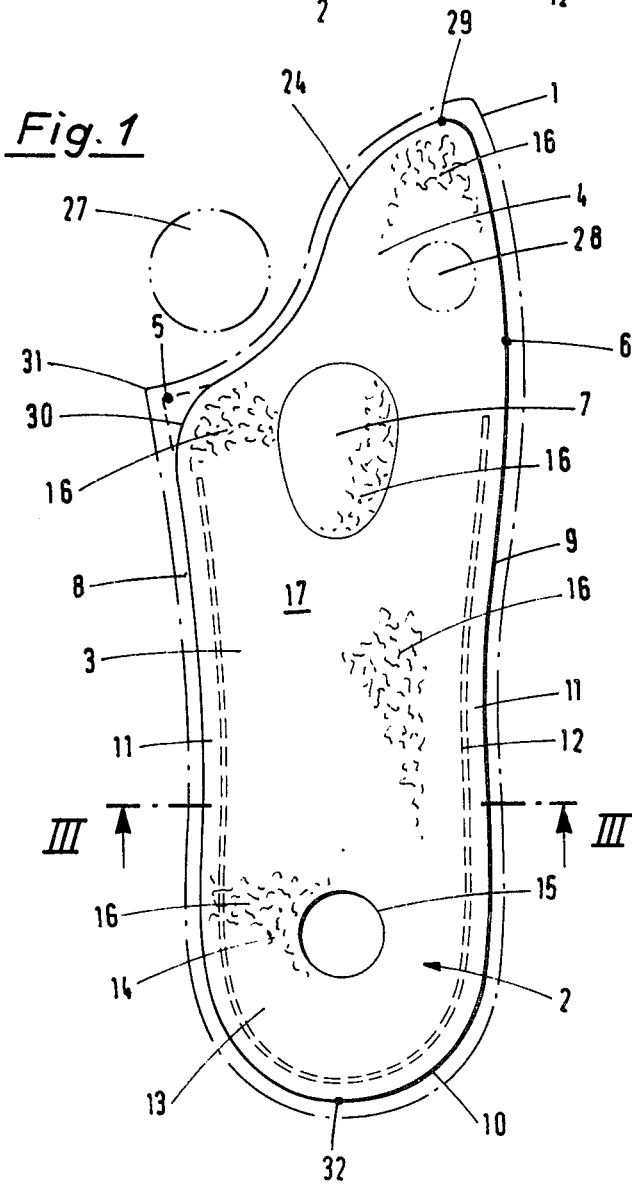
FIG. 1 is a plan view on an insole according to the invention for the right foot.

Further, in FIG. 1 it is indicated at several positions 16 that the upper side 17 of the insole 2 is roughened with a coarse grain, i.e. to a depth of about 0.2 to 0.3 mm and with a granulation of several millimeters over the area. This roughening above all provides a favourable compact face for the foot when there is a covering 1 of leather and, with an appropriate configuration, can also contribute to increasing the stiffness of the insole 2.

Figure 2:
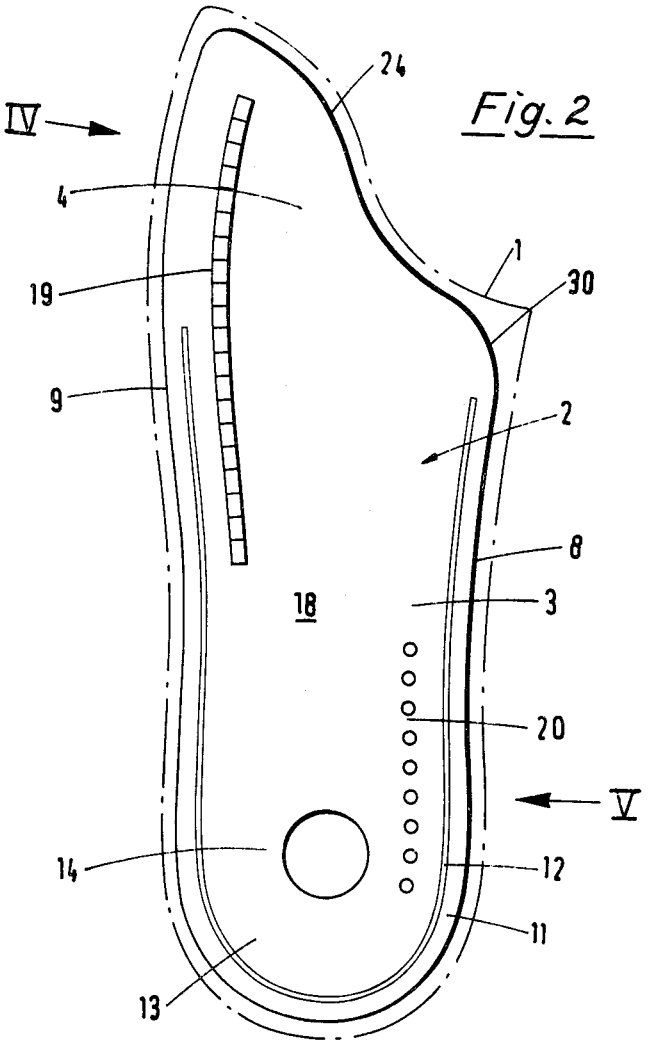
FIG. 2 is an underplan of FIG. 1.
Figure 4:
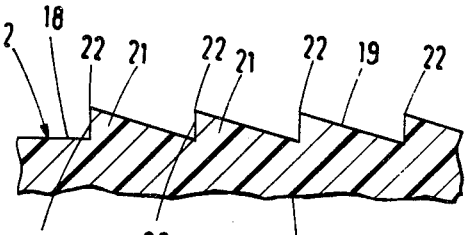
Figure 5:
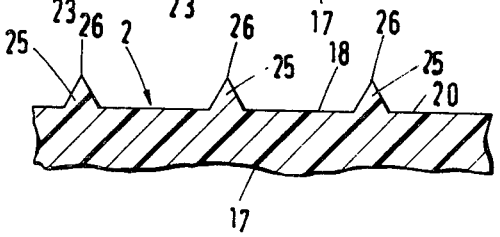

In two strip-like zones 19 and 20 (FIG. 2), the underside 18 is provided with sharp-edged projections, the projections of the zone 19 being shown to a larger scale in FIG. 4 and those of zone 20 in FIG. 5.

The projections 21 of the zone 19 at the outside of the foot extending substantially from the arch to near the ball of the little toe are of substantially sawtooth shape and have a roof-shaped sharp edge 22. Their disposition is such that the steeper flank 23 faces forwardly, i.e. towards the front bounding line 24 of the insole, so that forward slipping of the insole is prevented during use.

In the FIG. 5 embodiment, which is provided in the strip-like zone 20 between the arch and the heel zone 13 in the illustrated example, the projections 25 are conical. Their angle at the apex 26 is preferably less than 60°.

The features which are important for the wearing and function of the insole according to the invention reside in the special shaping which will hereinafter be described in more detail.

In insoles known hitherto, particularly insert insoles, the front boundary extended substantially along the line 5–6 in FIG. 1, that is to say behind the ball 27 of the big toe and the ball 28 of the little toe. In contrast, in the insole according to the invention the front bounding line 24 is disposed at such an angle to the longitudinal axis of the insole that, near the inside of the foot, the sole terminates behind the ball 27 of the big toe whereas at the outside of the foot the insole 2 extends up to the point 29 which is disposed a long distance in front of the ball 28 of the little toe. Between the points 5 and 29, the front bounding line 24 extends in substantially S shape, it always being ensured that the ball 27 of the big toe is disposed entirely in front of the insole 2 whereas the ball 28 of the little toe and the little toe and possibly also the fourth toe lie on the front zone 4 of the insole 2 in front of the line 5–6. The point 5 is an imaginary point at the intersection of the front bounding line 24 and the inner side edge 8 of the insole 2. In reality, the corner of the insole forming the point 5 is chamferred or rounded at 30 so that there will be no danger of damaging the shoe. The covering layer 1, however, projects suitably forwardly and forms a corner 31 which, since the covering layer 1 is made of soft material, cannot result in damage.

Now, the insole 2 is made from such a material that it possesses adequate stiffness to ensure that the ball 28 of the little toe and preferably also the little toe are supported during the rolling motion of the foot when walking by means of the front zone 4, i.e. the zone between the lines 5–6 and the point 29, the support being so intensive that during rolling the foot is turned towards the ball 27 of the big toe or the big toe which is not shown in the drawing is turned inwardly. In this way one obtains a walking motion which exerts a large strain on the joint of the big toe without creating the tendency for the big toe to be displaced inwardly and consequently there is no fear of the aforementioned foot ailments.

Since the insole 2 usually also converges near the front bounding line 24 so that no edge is formed, there is substantial latitude to the extent by which the front zone 4 projects up to the point 29 beyond the imaginary line 5–6. In the illustrated insole, the dimensions are now so selected that the measurement between the point 5 in the region of the inside of the foot and the point 32 at the heel is about 70% of the measurement between the point 29 at the tip of the insole 2 and the point 32 at the heel. Such dimensioning of the sole offers the advantage that one and the same insole can be employed for several foot sizes, for example three whole shoe sizes according to the English or French system. In the case of relatively small feet or comparatively long toes, the front bounding line 24 will then be comparatively close to the ball 27 of the big toe whilst in the case of larger feet or shorter toes the spacing between the ball 27 of the big toe and the front bounding line 24 is correspondingly greater. Similarly, for large feet or short toes the ball 28 of the little toe will be disposed relatively far forwardly in the zone 4, i.e. near the point 29, so that the little toe will only partially rest on the zone 4 of the insole 2 or not rest on it at all, whereas for small feet or long toes the ball 28 of the little toe might be disposed comparatively close to the line 5–6. If in such a case the zone 4 or the point 29 is disposed so far forwardly that insertion of the insole in the shoe presents difficulties, the front end of the zone 4 can simply be cut short near the point 29 by means of scissors or the like.

It is also evident from the drawing that the front bounding line 24 is substantially S-shaped and meets the side edges 8 and 9 of the insole almost at right-angles at its start and end, respectively, i.e. substantially at the points 5 and 29. This S-shaped configuration of the front bounding line 24 has the advantage that pressure points cannot normally be set up even if the bounding line 24 were to define a certain edge.

As already mentioned, the fact that there is a considerable difference in length between the measurement 5-32 at the inside of the foot and the measurement 29-32 at the outside of the foot permits one to make do with a few insole sizes. The reason for this is that, if the inner length 5-32 is only about 70% of the outer length 29-32, this means that the length of the insole at the inside of the foot from the heel to the bounding line 24 behind the ball 27 of the big toe is dimensioned according to a measurement which corresponds to a shoe size that is several size graduations, in the present case three, smaller than the shoe size corresponding to the measurement 29-32 according to which the length of the insole 2 is dimensioned at the outside of the foot from the heel to the bounding line 24 in the zone of the ball 28 of the little toe. It is therefore sufficient to provide, say, three insole sizes for men or women, the following measurements being practical:

Men's Shoes
- Insole sizes 40–42 or 6–8 (group size 'He K')
- Length 5-32 152.6 mm, with covering about 156 mm
- Length 29-32 218.0 mm, with covering about 221 mm
- Insole sizes 42–44 or 8–10 (group size 'He M')
- Length 5-32 162.4 mm, with covering about 165 mm
- Length 29-32 232.0 mm, with covering about 235 mm
- Insole sizes 44–46 or 10–12 (group size 'He G')
- Length 5-32 172.2 mm, with covering about 172 mm
- Length 29-32 246.0 mm, with covering about 249 mm Women's Shoes
- Insole sizes 34–37 or 2–4 (group size 'Da K')
- Length 5-32 132.8 mm, with covering about 136 mm
- Length 29-32 18.7 mm, with covering about 193 mm
- Insole sizes 37–40 or 4–6 (group size 'Da M')
- Length 5-32 142.8 mm, with covering about 146 mm
- Length 29-32 204.0 mm, with covering about 207 mm
- Insole sizes 40–42 or 6–8 (group size 'Da G')
- Length 5-32 155.0 mm, with covering about 158 mm
- Length 29-32 221.4 mm, with covering about 224 mm.

Accordingly, with only three insole sizes for women and three for men it is possible to cover practically all normally occurring shoe sizes. In the transitions, for feet with longer toes one should use the respective smaller group size and for feet with comparatively short toes one should use the respective larger group size.

The basic concept of the invention, namely the relatively stiff beam at the outside of the foot, can be put into effect in shoes not only by means of a special built-in part of the shoe but also for example by appropriate shaping and construction of an insole, e.g. a moulded rubber insole.

We claim:

1. A foot-supporting insole made of a resiliently flexible material of substantially constant thickness over its entire area, said insole being curved upwardly at the inside of the foot for supporting the arch of the foot and having a stiffness at least at the outside zone of the foot, said insole extending from the heel zone up to an S-shaped front bounding line which extends generally obliquely to the longitudinal axis of the foot and substantially perpendicular to the inner and outer edges of the insole at both its start and end such that the S-shaped bounding line passes in front of the ball of the little toe at the outside of the foot and behind the ball of the big toe on the inside of the foot, whereby during rolling motion when walking the foot is turned towards the big toe.

2. A foot-supporting insole according to claim 1, wherein a stiffening insert of elastically flexible material is provided at the outside of the foot extending up to beneath the ball of the little toe.

3. A foot-supporting insole according to claim 1, wherein the length of the insole at the inside of the foot from the heel to the bounding line behind the ball of the big toe is dimensioned according to a measurement corresponding to a shoe size which is several sizes smaller than the shoe size corresponding to the measurement according to which the length of the insole at the outside of the foot is dimensioned from the heel to the bounding line near the ball of the little toe.

4. A foot-supporting insole according to claim 1, wherein the length of the insole at the inside of the foot from the heel to the bounding line behind the ball of the big toe is dimensioned according to a measurement corresponding to a shoe size which is at least three sizes smaller than the shoe size corresponding to the measurement according to which the length of the insole at the outside of the foot is dimensioned from the heel to the bounding line near the ball of the little toe.

5. A foot-supporting insole according to claim 3, wherein the length of the insole at the inside of the foot is about 70% of the length at the outside.

6. A foot-supporting insole according to claim 3, wherein a marginal strip relatively easily highly flexible compared with the remaining area of the insole is provided along the side edges.

7. A foot-supporting insole according to claim 6, wherein said marginal strip is also provided around the heel.

8. A foot-supporting insole according to claim 6, wherein said marginal strip is formed by a line of weakness extending substantially parallel to the edge of the insole.

9. A foot-supporting insole according to claim 1, wherein the upper side of the insole is roughened with a coarse grain.

10. A foot-supporting insole according to claim 1, wherein the insole is covered at least on the upper side with a soft resilient covering layer which projects somewhat beyond the insole on all sides.

11. A foot-supporting insole according to claim 1, wherein the underside of the insole is at least partly provided with sharp-edged projections preventing displacement of the insole in use.

12. A foot-supporting insole according to claim 11, wherein said projections are respectively disposed in a strip between the heel zone and arch at the inside of the foot and a strip between the arch and the ball of the little toe at the outside of the foot.

13. A foot-supporting insole according to claim 1, wherein said insole is removable from a shoe.

14. A foot-supporting insole according to claim 1, wherein said insole is part of a shoe.

15. A foot-supporting insole for providing rolling motion of the foot towards the big toe during walking, said insole being made of a resiliently flexible material of substantially constant thickness and being curved upwardly at the inside of the foot for supporting the arch of the foot and having a stiffness at the outside zone of the foot for supporting the outside of the foot, said insole extending from the heel zone up an S-shaped bounding line which extends generally obliquely to the longitudinal axis of the foot and substantially perpendicular to the inner and outer edges of the insole at both its start and end such that the S-shaped bounding line passes in front of the ball of the little toe at the outside of the foot and behind the ball of the big toe on the inside of the foot, whereby said insole is free of any underlying support for the ball of said big toe while having a portion underlying and supporting the ball of the little toe, said stiffness at the outside zone of the foot together with the underlying support of the ball of the little toe and the lack of support of the ball of the big toe providing a natural rolling motion of the foot toward the big toe during walking.

16. A foot-supporting insole providing rolling motion of the foot towards the big toe during walking and useable in shoes of plural sizes, said insole being made of a resiliently flexible material of substantially constant thickness and being curved upwardly at the inside of the foot for supporting the arch of the foot and having a stiffness at the outside zone of the foot for supporting the outside of the foot, said insole extending from the heel zone up an S-shaped bounding line which extends generally obliquely to the longitudinal axis of the foot and substantially perpendicular to the inner and outer edges of the insole at both its start and end such that the S-shaped bounding line passes in front of the ball of the little toe at the outside of the foot and behind the ball of the big toe on the inside of the foot, whereby said insole is free of any underlying support for the ball of said big toe while having a portion underlying and supporting the ball of the little toe, said stiffness at the outside zone of the foot together with the underlying support of the ball of the little toe and the lack of support of the ball of the big toe providing a natural rolling motion of the foot toward the big toe during walking, said insole having a length at the inside of the foot from the heel to said bounding line behind the ball of the big toe which corresponds to a shoe size which is several times smaller than the shoe size corresponding to the length of the sole at the outside of the foot from the heel to said bounding line near the ball of the little toe, whereby the insole is useable in shoes of a plurality of sizes while providing said rolling motion of the foot in said shoes of plural sizes.

* * * * *